United States Patent [19]

Greenberg

[11] 4,223,471

[45] Sep. 23, 1980

[54] AQUARIUM CRIB TOY

[75] Inventor: Sheldon Greenberg, Fort Lee, N.J.

[73] Assignee: Shelcore, Inc., New York, N.Y.

[21] Appl. No.: 969,285

[22] Filed: Dec. 13, 1978

[51] Int. Cl.[3] ..... A63H 29/10

[52] U.S. Cl. ..... 46/41; 46/32; 46/44; 46/91; 273/1 L

[58] Field of Search ..... 46/41, 42, 32, 91, 95, 46/94, 44, 1 R; 273/1 L, 95 C, 85 H, 119 B

[56] References Cited

U.S. PATENT DOCUMENTS

| | | | |
|---|---|---|---|
| 1,473,178 | 11/1923 | Dray | 273/95 C |
| 3,577,675 | 5/1971 | Kohner | 46/41 |
| 4,032,141 | 6/1977 | Tanimura | 46/44 X |
| 4,136,872 | 1/1979 | Matsumoto | 273/1 L X |
| 4,142,724 | 3/1979 | Reick | 273/1 L X |

FOREIGN PATENT DOCUMENTS

| | | | |
|---|---|---|---|
| 599930 | 6/1934 | Fed. Rep. of Germany | 273/95 C X |

*Primary Examiner*—Robert Peshock
*Assistant Examiner*—Mickey Yu
*Attorney, Agent, or Firm*—Kirschstein, Kirschstein, Ottinger & Cobrin

[57] ABSTRACT

An amusement device for infants, babies and small children, especially intended to be mounted to a side wall of a crib. The device includes a transparent enclosure which in practice is filled with a liquid, and which contains at least one movable object such as a sphere or a simulation of a fish. The density of the object or objects is greater than the density of the liquid. A flexible resilient bellows extends from the lower end of the enclosure and a liquid transmission pipe or nozzle extends between the enclosure and the bellows. The bellows may be manually expanded by the infant or child, so that a body of the liquid is drawn from the enclosure into the bellows. A spring extends from the bellows to a lower fixed mounting, so that when the bellows is manually expanded, the spring is compressed against the lower fixed mounting and urges the bellows to an idle contracted shape, so that liquid is expelled from the bellows into the enclosure when the child releases the bellows expansion element. Thus, the expelled liquid agitates and circulates the liquid in the enclosure, so that the object or objects in the enclosure move about within the body of liquid in the enclosure in a manner pleasing and amusing to the child, baby or infant, who can readily see the motion of the objects through the transparent wall of the enclosure.

9 Claims, 4 Drawing Figures

FIG. 1
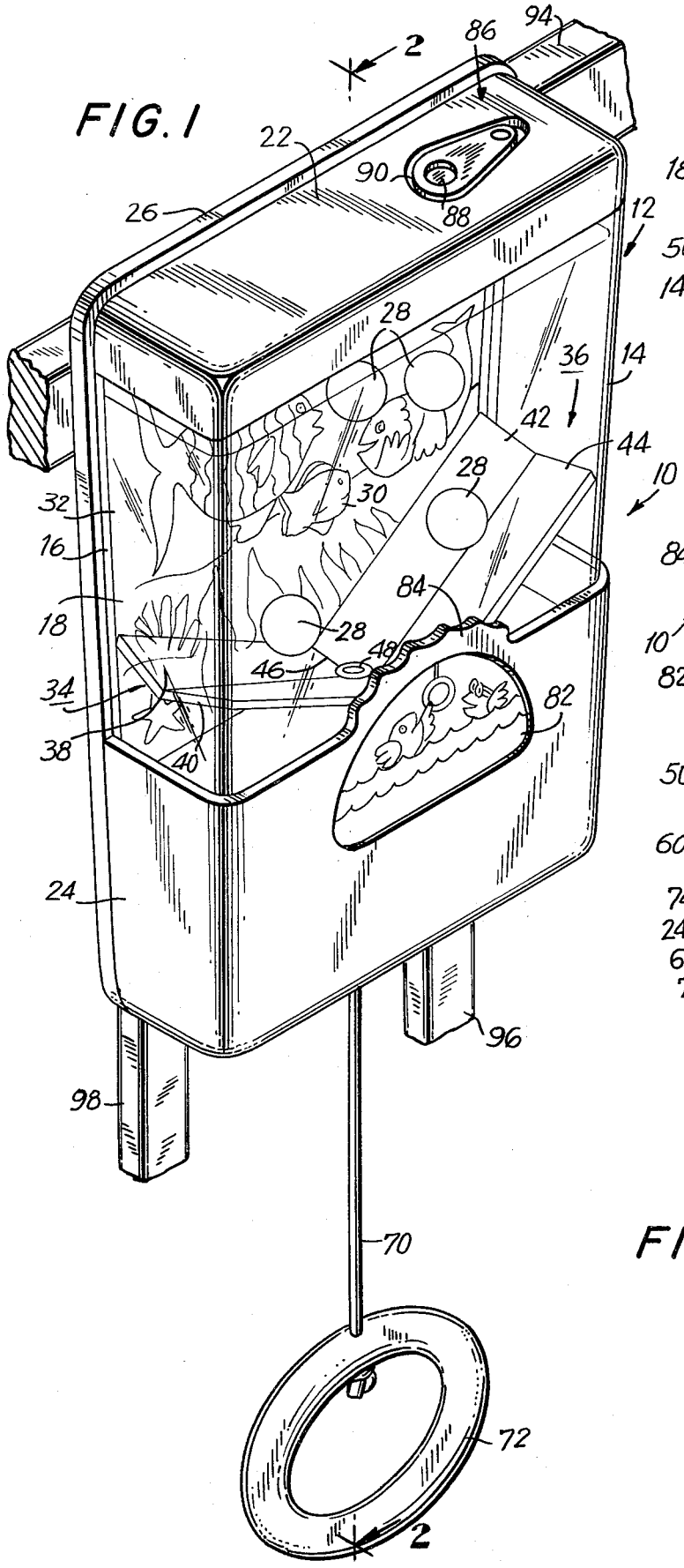
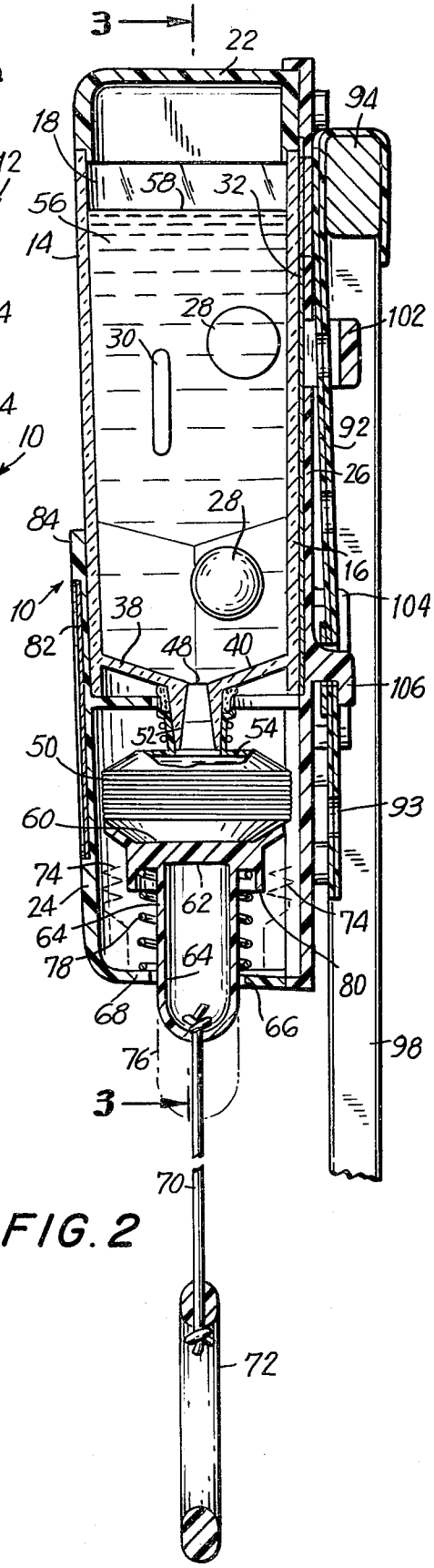
FIG. 2

AQUARIUM CRIB TOY

BACKGROUND OF THE INVENTION

1. Field of the Invention

An object motion toy in which random motion of the objects is initiated at the discretion of a child.

2. Description of the Prior Art

Numerous types of motion toys have been suggested for the amusement of infants and small children. It has recently been recognized by pediatricians and others active in the field that babies have a sense of awareness and recognition almost from the moment of birth. Thus, even the smallest baby in a crib soon senses its surroundings, and crib toys are feasible for even the youngest of babies. Pediatricians now recognize that the stimulation and amusement of the mind of the baby may be accomplished almost from the day of birth. Typical crib toys for mounting to or in the proximity of a crib holding a baby or infant include wind-up toys which actuate small labile mobiles having mounted toy butterflies, birds or the like, toy clocks having visible pendulums, especially cuckoo clocks, and toys in which motion of objects takes place inside a transparent enclosure visible to the child or infant. In the latter instance, random motion of the objects may be initiated by the flow of a fluid such as air or water inside the enclosure. This fluid flow may be initiated in various ways, and the motion of the objects may be either random or directed to a target, e.g. a ring-toss toy or a toy with the objective of placing spheres such as balls into pockets. These games and toys are as much fun to look at as they are to play with. The slow motion of the rings and/or balls is controlled, typically with a button that forces air currents or a stream of water into a transparent tank or other enclosure. The objective may be to get three or more balls in a row in their pockets, or to try to get all of the balls in. In ring toss, the objective is to get all of the rings on the pegs. Such toys are intended for older children, typically five years of age or older, who can understand the objective of maneuvering the pieces into the right places. Generally, the tank or other enclosure is filled with water, however, air actuation may also be employed. In such toys, the pressing of the manual push button actuates the device by pushing a plunger or the like, or by contracting a bellows which has been gravity-filled via water pressure.

Pertinent prior art relative to such toys includes U.S. Pat. Nos. 806,255; 1,850,715; 2,100,898; 2,968,120; 3,014,307; 3,060,628; 3,106,394; 3,978,610; and 4,032,141; British Pat. No. 637,984 and French Patent No. 1,176,080.

SUMMARY OF THE INVENTION

1. Purposes of the Invention

It is an object of the present invention to provide an improved object motion toy.

Another object is to provide an improved aquarium crib toy.

A further object is to provide a toy for the amusement a entertainment of babies, infants and small children.

An additional object is to provide an inexpensive, rugged, serviceable and reliable object motion toy which may be mass produced at low cost.

Still another object is to provide an amusement device consisting of an aquarium crib toy which stimulates the mind of even the smallest or youngest baby or infant.

Still a further object is to provide an aquarium crib toy which is simple and easy to operate by a baby, infant or small child.

Still another object is to provide an object motion toy in which intermittent motion of the object or objects, predicated on an action by the user consisting of tugging on a pull string or cord, is accomplished.

Still a further object is to provide an object motion toy in which the motion of the object or objects is instigated by flow of a current of liquid, which liquid current is initiated in an improvement manner.

These and other objects and advantages of the present invention will become evident from the description which follows.

2. Brief Description of the Invention

In the present invention, the amusement device, consisting of a crib toy which typically simulates an aquarium, includes a transparent enclosure for containing a liquid, the enclosure being filled with the liquid, at least one, and typically a plurality, of movable objects within the enclosure, the density of the objects being greater than the density of the liquid, and a flexible resilient bellows. The bellows is mounted to the bottom of the enclosure, and means is provided for transmitting the liquid between the enclosure and the bellows. Means typically consisting of a pull cord or string with a terminal plastic ring is provided to manually expand the bellows, so that a body of the liquid is drawn from the enclosure into the bellows. Finally, a spring means is provided. The upper end of the spring means is mounted to the bellows, usually to the bottom or lower part of the bellows, and the lower end of the spring has a lower fixed mounting. Thus, when the bellows is manually expanded downwards, the upper end of the bellows being fixed, the spring means is compressed against the lower fixed mounting and potential energy is stored in the spring means, i.e., the spring means tends to urge the bellows to a contracted shape, so that when the manual means to expand the bellows is released, a surge of liquid is expelled from the bellows into the body of liquid in the enclosure, whereby the objects are agitated and swirl and move about within the body of liquid in the enclosure, as the expelled liquid circulates and generates currents in the body of liquid.

Typically, the transparent enclosure is a rectangular parallelepiped with a V-shaped base wall, the apex of the base wall having an opening in fluid communication with the means for transmitting liquid between the enclosure and the bellows. This configuration is preferred since the V-shaped base wall tends to urge the objects to settle centrally adjacent to the opening, so that the surge of liquid from the contracting bellows strikes the settled objects directly and thus provides greater subsequent movement of the objects about in the body of liquid. In a preferred embodiment, each side of the V-shaped base wall is a V-shaped trough, so that the means for transmitting liquid between the enclosure and the bellows extends from the single lowest part of the enclosure, this single lowest part or point of the enclosure being centrally disposed with respect to each pair of registered side walls of the enclosure.

Typically, the means to transmit liquid between the enclosure and the bellows is a nozzle, which nozzle extends between the enclosure and the bellows and is in fluid communication with both the enclosure and the bellows. In the preferred embodiment in which the enclosure has a V-shaped base wall, the nozzle extends from the apex of the base wall. In this embodiment, typically each side of the V-shaped base wall is a rectilinear trough having a V-shaped cross-section. The sides of the V-shaped base wall will usually be at an obtuse angle relative to each other, and each side rectilinear V-shaped trough will usually be an obtuse-angled trough.

Generally, the bellows and the spring means will be cylindrical and coaxial.

In a preferred embodiment, one end of the bellows is mounted to the head of a movable piston, so that the movable piston coaxially extends from the bellows. The cylindrical spring means is concentrically disposed about the rectilinear rod of the movable piston, and extends between the head of the movable piston and the lower fixed mounting of the spring means. The rod slidably extends through an opening in the lower fixed mounting of the spring means, to flexible means, such as a cord or string, for displacing the movable piston away from the enclosure. The head of the movable piston is of greater dimension than the opening in the lower fixed mounting of the spring means. In this embodiment of the invention, preferably the head of the piston is provided with an annular circular lip, which lip extends from the head of the piston about the upper end of the spring means.

The present invention provides several salient advantages. The toy simulates an aquarium, with random circulating motion of the objects in the body of liquid in the enclosure or container, which appeals to the eye and mind of even the smallest infant or baby and arouses the curiosity and interest of the child. As will appear infra, the toy is especially adapted for mounting to the side wall of a crib, and thus the child, baby or infant in the crib, who may have nobody to play with or no other toys in the crib, is attracted and fascinated by the present object motion toy, especially since the motion of the objects is instigated by the child or infant. Thus the child learns at an early age to understand cause and effect, as well as control of his or her surroundings and inanimate objects. Thus the toy is educational as well as being beneficial for the amusement and entertainment of babies, infants and small children. The present toy is an inexpensive, rugged, serviceable and reliable object motion toy, which may be mass produced at low cost. The present aquarium crib toy is an amusement device which stimulates the mind of even the smallest or youngest baby or infant, by preventing sensory deprivation in the crib due to the provision of random motion of objects which may be seen and understood by the child, baby or infant. The present toy is simple and easy to operate by the baby, infant or small child. The present object motion toy accomplishes intermittent motion of the object or objects, predicated on a positive action by the user consisting of pulling or tugging on a pull string or cord, followed by the release of same, which is educational to the infant or small child in teaching manipulation and the use of the hands for something besides merely grasping objects such as a rattle, teething ring, or pacifier. Finally, in the present invention, the motion of the object or objects is instigated by flow of a current of liquid, which liquid current flow is initiated in an improved manner and in a controllable periodic surge.

The invention accordingly consists in the features of construction, combination of elements, and arrangement of parts which will be exemplified in the article of manufacture hereinafter described and of which the scope of application will be indicated in the appended claims.

BRIEF DESCRIPTION OF THE DRAWINGS

In the accompanying drawings in which is shown one of the various possible embodiments of the invention:

FIG. 1 is a perspective view of the present aquarium crib toy mounted to the side wall of a crib;

FIG. 2 is a sectional elevation view taken substantially along the line 2—2 of FIG. 1;

DETAILED DESCRIPTION OF THE PREFERRED EMBODIMENTS

Figure 4:
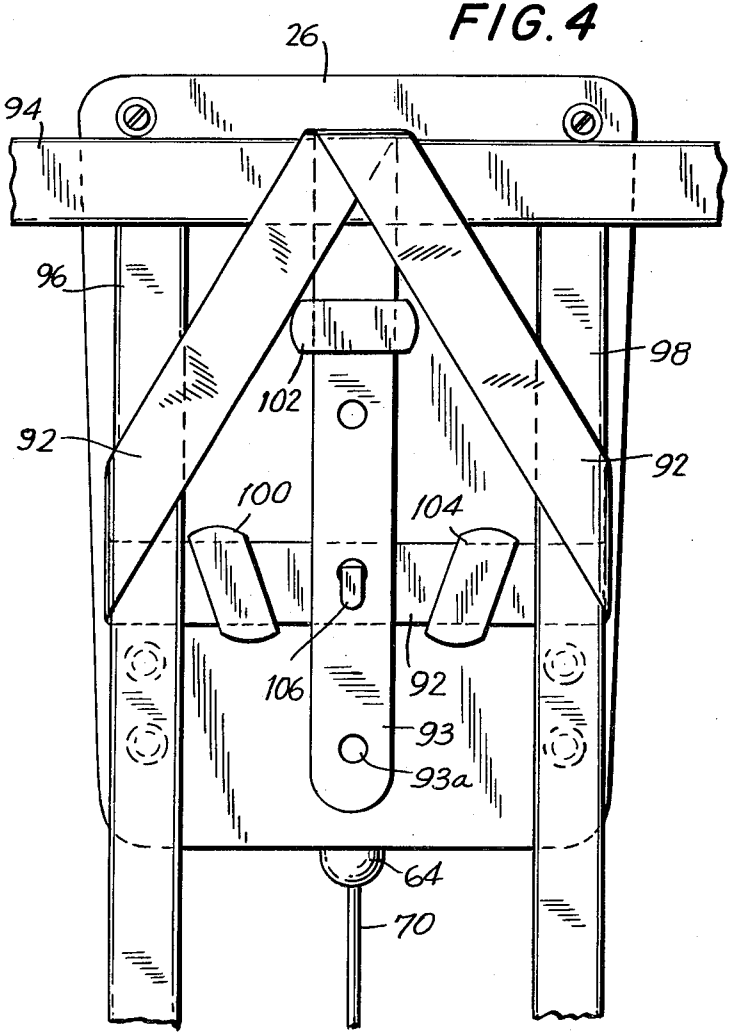
FIG. 4 is an elevation view of the backside of the toy as mounted to the slats of the crib side wall.

Referring now to the figures, the present amusement device 10 basically includes a transparent rectangular parallelepiped enclosure or container 12 having a front wall 14, a rear wall 16, and side walls 18 and 20. The enclosure or container 12 is filled almost to the top with a liquid, typically water, and the enclosure is mounted in a plastic frame holder having an upper portion 22, a lower portion 24 and a detachable rear portion 26. As will appear infra, the lower plastic portion 24 provides the lower fixed mounting for the spring means to be described infra. Typically, the transparent container or enclosure 12 is constituted from a clear plastic such as polyethylene, methylmethacrylate or other acrylic resin, nylon or the like; however, the element 12 alternatively could be made of glass. The plastic mounting members 22, 24 and 26, which provide a continuous body and structural integrity for the device, are typically made or constituted from a colored plastic such as colored polyvinyl chloride, polyethylene, or polypropylene, especially isotactic polypropylene.

A plurality of movable objects are contained in enclosure 12; in this case, the objects are four spheres or balls 28 and a simulation of the shape of a fish, this latter object being element 30. Background representations of fishes and other marine objects are provided on a poster or picture card 32 mounted immediately to the rear of the rear wall 16 of the enclosure 12. The element 32 is of course visible throught the transparent front and back walls 14, 16, so that the child sees not only the moving objects 28 and 30 but also the background pictures and illustrations on the card 32, so that the simulation of a liquid-filled aquarium is complete. As mentioned supra, the container 12 is filled with water or other suitable liquid; water is preferred for obvious reasons, and the objects 28 and 30, formulated in most instances of hollow plastic, have a density greater than the density of the liquid, so that when the body of liquid is agitated or stirred by a liquid current as will appear infra, the objects 28 and 30 circulate or float upwards and about in the body of liquid and thereafter eventually settle to the bottom of the container or enclosure 12.

Figure 3:
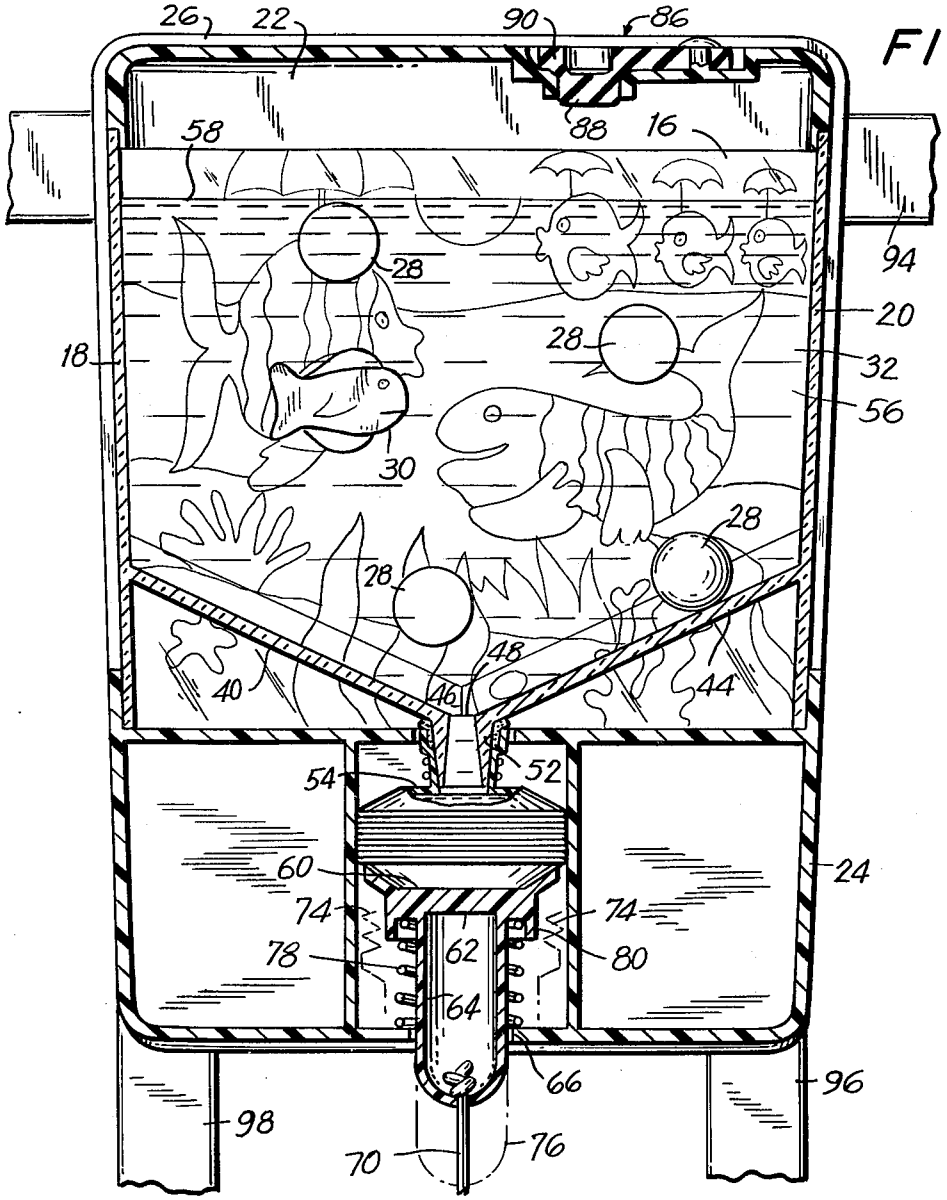
FIG. 3 is a sectional elevation view taken substantially along the line 3—3 of FIG. 2.

The lower part, i.e. the bottom, of the container 12 is of a specific configuration in accordance with the present invention. The bottom of the container 12, viewed as a whole, is a V-shaped base wall having two portions 34 and 36, which portions or sides of the V-shaped base wall are at an obtuse angle to each other, as best shown in FIG. 3. Each side 34 or 36 of the V-shaped base wall is a V-shaped trough having two planar sections at an obtuse angle to each other. Thus, the side 34 consists of sections or panels 38 and 40 (FIG. 2), and the side 36 consists of sections or panels 42 and 44. The purpose and objective of this configuration is to direct and urge the objects 28 and 30, as they settle downwards, to the lower center of the enclosure 12, so that, as will appear infra, when a surge or current of liquid is directed into the container 12 from the bottom center, it will have maximum effect in circulating the objects 28 and 20 upwards and about the body of liquid, typically so that they float or lazily move up and down. Thus, the V-shaped base wall 34, 36 of the transparent enclosure 12 is characterized by having a bottom central apex 46 having an opening 48 at its center, which opening 48 is at the single lowest part of the enclosure 12. This opening 48 at the single lowest part of the enclosure 12 is centrally disposed with respect to each pair of registered side walls of the enclosure 12, the pairs of registered side walls being viewed as walls 14 and 16, and 18 and 20.

A flexible resilient bellows 50, composed of natural or synthetic rubber, such as buna-S, neoprene etc., or a flexible plastic, is dependent and extends downwards from the bottom of the enclosure 12; in this embodiment of the invention, bellows 50 is suspended from and depends downward from the enclosure 12 via an intermediate nozzle or pipe 52 which extends between the opening 48 and the upper end 54 of the bellows 50, which upper end 54 is fixed to the lower end of the nozzle 52 and is not displaceable in practice. The nozzle or pipe 52 constitutes a means for transmitting the liquid between the enclosure 12 and the bellows 50, i.e. the nozzle 52 extends between and is in fluid communication with both the enclosure 12 and the bellows 50, and the nozzle 52 depends from the center opening 48 at the apex 46 of the base or bottom wall 34, 36 of the enclosure 12.

Within the context of the present invention, means is provided to manually expand the bellows 50, so that a working body of the liquid is drawn from the enclosure 12 into the bellow 50, the main body of liquid in the enclosure being designated as 56 having an upper surface or level at 58. In this embodiment of the invention, the means to manually expand the bellows includes a movable piston, the lower end 60 of the bellows 50 being mounted to the head 62 of the movable piston. Thus the movable piston, which also has a rod 64 which depends downwards from the head 62, coaxially depends from the bellows 50. The rod 64 slidably extends through a lower bottom opening 66 in the bottom portion 68 of the member 24, which portion 68 will appear infra constitutes a lower fixed mounting for spring means to be described infra. The rod 64 extends to flexible manual means for displacing the movable piston (members 62 and 64), downwards and away from the enclosure or container 12, the head 62 of the movable piston being of greater dimension, in this case greater diameter, than the opening 66, both opening 66 and head 62 being circular and coaxial in this embodiment of the invention. The flexible manual means for displacing the movable piston typically consists, as shown, of a string, rope, wire or cable or chain 70, knotted at each end, which extends from the lower end of the rod 64 to a plastic ring 72 which may readily be grasped by the child, infant or baby, so that the element 70 may be tugged and the bellows manually expanded downwards from the upper fixed end 54 to the configuration shown in phantom outline as 74, with the piston rod being also displaced to the lower disposition shown in pantom outline as 76. This manual action of expanding the bellows 50 serves to draw liquid from the body 56 in the enclosure 12 into the bellows 50.

The invention is completed in its broadest embodiment by the provision of spring means, consisting in this case of the cylindrical helical metal compression spring 78, which spring means 78 depends and extends downwards from the lower end 60 of the bellows 50, or basically from the piston head 62 to the lower fixed mounting 68 described supra. The bellows 50 is cylindrical in this embodiment of the invention, and coaxial with the spring means 78. In addition, the spring means 78 is concentrically disposed about the rod 64 of the movable piston and, as mentioned supra, the spring means 78 in this embodiment of the invention extends between the head 62 of the movable piston and the lower fixed mounting 68. When the bellows is manually expanded as described supra, the spring means 78 is compressed against the lower fixed mounting 68 and tends to urge the bellows 50 to an idle contracted shape. Thus, when the manual means to expand the bellows 50 described supra is released by the child, the spring means 78 immediately pushes the bellows 50 to a contracted shape and the piston head 62 moves upwards, the liquid is expelled from the bellows 50 into the enclosure 12 through the nozzle 52 and opening 48, so that a current of liquid is generated in the body 56 of liquid and the previously settled objects 28 and 30 are caused to move and swirl about, e.g., to float or lazily move up and down, in the liquid body 56 in simulation of an aquarium.

Various appurtenances are shown in this preferred embodiment of the invention. The head 62 of the movable piston is preferably provided with an annular circular lip 80, to seat the spring means 78. This lip 80, as shown, depends and extends downwards from the head 62 of the movable piston about the upper end of the spring means 78.

An illustration panel 82 comparable in appearance to the element 32 described supra is mounted to the front of the bottom frame member 24, with the extension 84 of the front of the frame member 24, and the panel 82, covering and hiding the egress of liquid from opening 48 and the initial motion upwards of the objects 28 and 30, so that these objects 28 and 30 appear to float and move about in the enclosure 12 without any visible means of initiating motion, as is the case with a real aquarium.

A top filling fitting 86 having a rubber plug 88 is provided for initial passage of liquid into the container or enclosure 12 when the toy is first procured. The rubber plug 88 is manually opened by urging edge 90 upwards, the entire unit being resilient and flexible; then the entire device is held under a slowly running faucet so that water, the preferred liquid, will flow through the opening where plug 88 was previously seated and fill the device. Then the rubber plug is seated firmly in place and the case, or entire device, is blotted dry.

As discussed supra, the device is preferably used in conjunction with a crib. Thus, as best seen in FIG. 4, a strap 92 having terminal ends 93 with a linear series of holes **93*a* is employed to hold the device inside of a crib or playpen, with its back 26 against the crib side as shown. The crib or playpen side has a top horizontal rail or slat 94 and vertical side rails or slats 96,98. The strap 92 is threaded through bails 100, 102, 104 on the rear side of the element 26, and the holes in the ends of the strap 92 permit the mounting of the strap ends to a hook 106 which is integral with the backside element or member 26. Thus the strap 92 is looped about the slats or rails 94, 96, 98 and secured via the hook 106, with the coaction between the strap 92 and the bails 100, 102, 104** serving to hold the device firmly in place.

It thus will be seen that there is provided an article of manufacture consisting of an aquarium crib toy amusement device which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although a preferred embodiment has been shown and described in accordance with the Patent Statutes, the invention is not limited thereto or thereby.

Having thus described the invention, there is claimed as new and desired to be secured by Letters Patent:

1. An amusement device comprising a transparent enclosure for containing a liquid, at least one movable object within said enclosure, the density of said object being greater than the density of said liquid, a flexible resilient bellows, said bellows depending from said enclosure, means for transmitting said liquid between said enclosure and said bellows, means to manually expand said bellows, so that a body of said liquid is drawn from said enclosure into said bellows, compressing spring means, said spring means depending from said bellows and having a lower fixed mounting, so that when said bellows is manually expanded, said spring means is compressed against said lower fixed mounting and urges said bellows to an idle contracted shape, whereby liquid is expelled from said bellows into said enclosure, when said manual means to expand said bellows is released, and a movable piston, one end of said bellows being mounted to the head of said movable piston, so that said movable piston coaxially depends from said bellows, said spring means being concentrically disposed about the rod of said movable piston and extending between the head of said movable piston and said lower fixed mounting, said rod slidably extending through an opening in said lower fixed mounting of said spring means to flexible means for displacing said movable piston away from said enclosure, said piston and said flexible displacement means constituting said means to manually expand said bellows, the head of said movable piston being of greater dimension than the opening in said lower fixed mounting of said spring means.

2. The amusement device of claim 1 in which the transparent enclosure is a rectangular parallelepiped with a V-shaped base wall, the apex of said base wall having an opening in fluid communication with the means for transmitting liquid between the enclosure and the bellows.

3. The amusement device of claim 2 in which each side of the V-shaped base wall is a V-shaped trough, so that the means for transmitting liquid between the enclosure and the bellows extends from the single lowest part of the enclosure, said lowest part of the enclosure being centrally disposed with respect to each pair of registered side walls of the enclosure.

4. The amusement device of claim 1 in which the means to transmit liquid between the enclosure and the bellows is a nozzle, said nozzle extending between the enclosure and the bellows.

5. The amusement device of claim 4 in which the enclosure has a V-shaped base wall, the nozzle depending from the apex of said base wall.

6. The amusement device of claim 5 in which each side of the V-shaped base wall is a rectilinear trough having a V-shaped cross-section.

7. The amusement device of claim 6 in which the sides of the V-shaped base wall are at an obtuse angle to each other, and each side of the base wall is an obtuse-angled trough.

8. The amusement device of claim 1 in which the bellows is cylindrical and coaxial with the spring means.

9. The amusement device of claim 1 in which the head of the piston is provided with an annular circular lip, said lip depending from the head of the piston about the upper end of the spring means.

* * * * *